US008820416B2

(12) United States Patent
Holderman

(10) Patent No.: US 8,820,416 B2
(45) Date of Patent: Sep. 2, 2014

(54) ACTUATION ASSEMBLY FOR DOWNHOLE DEVICES IN A WELLBORE

(75) Inventor: Luke William Holderman, Plano, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 13/981,354

(22) PCT Filed: Jul. 27, 2012

(86) PCT No.: PCT/US2012/048518

§ 371 (c)(1),
(2), (4) Date: Jul. 24, 2013

(65) Prior Publication Data

US 2014/0027104 A1 Jan. 30, 2014

(51) Int. Cl.
*E21B 23/04* (2006.01)

(52) U.S. Cl.
USPC ..... 166/373

(58) Field of Classification Search
USPC ..... 166/373, 53
See application file for complete search history.

(56) References Cited

U.S. PATENT DOCUMENTS

| | | | | |
|---|---|---|---|---|
| 8,196,515 | B2 | 6/2012 | Streibich et al. | |
| 2007/0007014 | A1 | 1/2007 | Sessions et al. | |
| 2010/0175867 | A1 * | 7/2010 | Wright et al. | 166/57 |
| 2011/0056679 | A1 * | 3/2011 | Rytlewski | 166/250.01 |
| 2011/0056692 | A1 * | 3/2011 | Lopez de Cardenas et al. | 166/305.1 |
| 2012/0152562 | A1 | 6/2012 | Newton et al. | |
| 2012/0181036 | A1 | 7/2012 | Holderman | |

OTHER PUBLICATIONS

International Patent Application No. PCT/US2012/048518 , "International Search Report and Written Opinion", mailed Mar. 28, 2013 (11 pages).

* cited by examiner

*Primary Examiner* — Brad Harcourt
(74) *Attorney, Agent, or Firm* — Kilpatrick Townsend & Stockton LLP

(57) ABSTRACT

Certain aspects and features of the present invention are directed to an actuation assembly that can be disposed in a wellbore through a fluid-producing formation. The actuation assembly can include a body, a potential force in the body, and a device in the body. The device can cause the potential force to be released from the body in response to receiving a signal identifying a target device disposed in the wellbore.

15 Claims, 3 Drawing Sheets

ACTUATION ASSEMBLY FOR DOWNHOLE DEVICES IN A WELLBORE

CROSS-REFERENCE TO RELATED APPLICATIONS

This is a U.S. national phase under 35 U.S.C. 371 of International Patent Application No. PCT/US2012/048518, titled "Actuation Assembly for Downhole Devices in a Wellbore," filed Jul. 27, 2012, the entirety of which is incorporated herein by reference.

TECHNICAL FIELD OF THE INVENTION

The present invention relates generally to devices for controlling fluid flow in a wellbore in a subterranean formation and, more particularly (although not necessarily exclusively), to an actuation assembly for actuating devices in the wellbore of a producing well.

BACKGROUND

Flow control devices, such as inflow control devices, can control the rate of fluid flow from a well, such as an oil or gas well for extracting fluids that can include petroleum oil hydrocarbons from a subterranean formation. A flow control device can be used to balance flow throughout the length of a tubing string of a well system by balancing or equalizing pressure from a wellbore of horizontal well. For example, several flow control devices disposed at different points along a tubing string of a well can be used to regulate the pressure at different locations in the tubing string.

Changes in the reservoir pressure of a subterranean formation can change the rate of fluid flow through a well system over time. The controlled rate of fluid flow can be modified by changing the configuration of flow control devices. Flow control devices can include bypass mechanisms to reduce the restriction of fluid flow. Flow control devices can also include closure mechanisms to increase the restriction of fluid flow. The rate of fluid flow through the well system can be modified by actuating or otherwise configuring bypass mechanisms or closure mechanisms of flow control devices in the wellbore.

It is desirable to identify flow control devices and other target devices in a wellbore and change the configuration of the target devices.

SUMMARY

In one aspect, an actuation assembly is provided that can be disposed in a wellbore through a fluid-producing formation. The actuation assembly can include a body, a potential force in the body, and a device in the body. The device can cause the potential force to be released from the body in response to detecting a signal identifying a target device in the wellbore.

In another aspect, a system is provided that can be disposed in a wellbore through a fluid-producing formation. The system can include a target device and an actuation assembly. The actuation assembly can include a body, a potential force in the body, and a device in the body. The device can cause the potential force to be released from the body in response to identifying the target device. The potential force can change a configuration of the target device.

In another aspect, an actuation assembly is provided that can be disposed in a wellbore through a fluid-producing formation. The actuation assembly can include a body, a potential force in the body, a radio-frequency identification device, and a device in the body. The radio-frequency identification device can identify a target device by scanning a radio-frequency identification tag co-located with the target device. The device can cause the potential force to be released from the body in response to identifying the target device.

These illustrative aspects and features are mentioned not to limit or define the invention, but to provide examples to aid understanding of the inventive concepts disclosed in this application. Other aspects, advantages, and features of the present invention will become apparent after review of the entire application.

DETAILED DESCRIPTION

Figure 1:
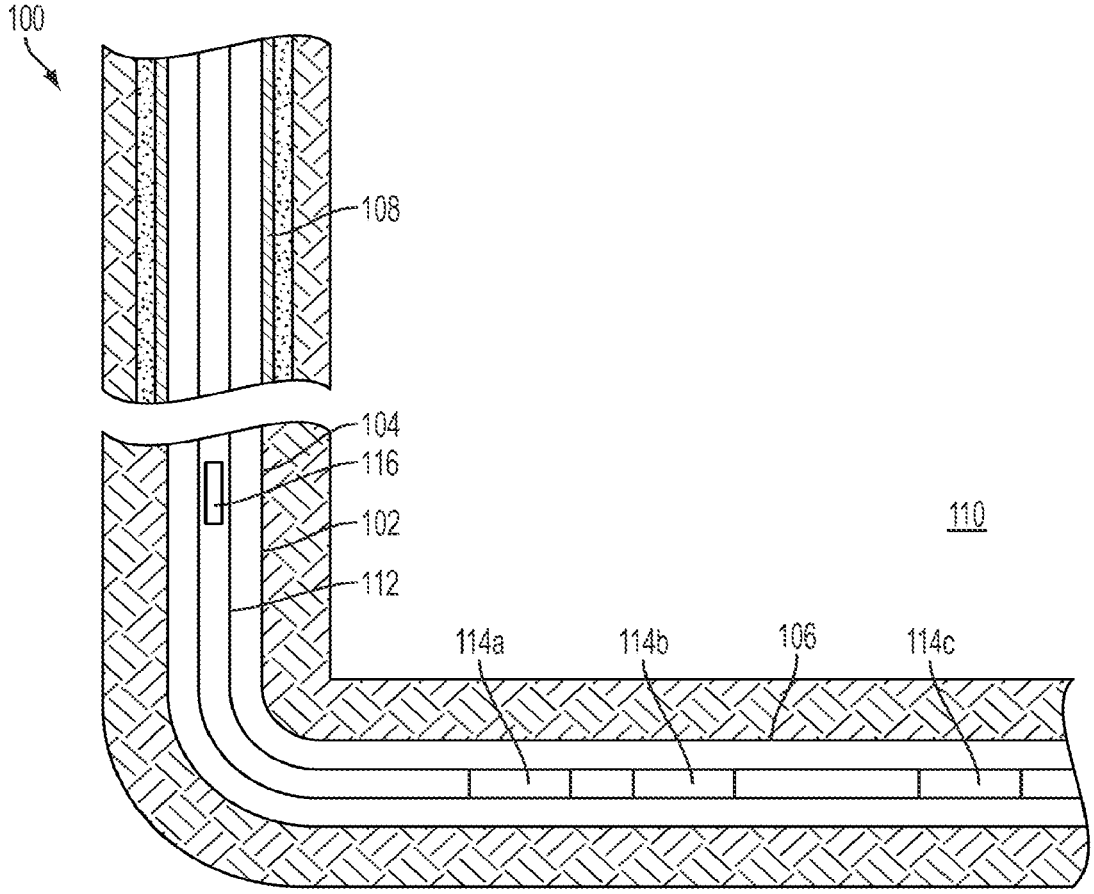
FIG. 1 is a schematic illustration of a well system having target devices and an actuation assembly for actuating the target devices according to one aspect of the present invention.

Certain aspects and features of the present invention are directed to an actuation assembly for actuating devices in the wellbore of a well system. The actuation assembly can recognize a target device in the wellbore. The actuation assembly can generate a force in response to recognizing the target device. The actuation assembly can cause the force to be applied to the target device, thereby actuating or otherwise configuring the target device. The actuation assembly can selectively actuate or otherwise configure multiple target devices in a wellbore. For example, the actuation assembly may configure only three identified target devices out of twelve target devices disposed in the wellbore.

In some aspects, an actuation assembly can generate the force by mixing two chemicals to generate pressure. The actuation assembly can be adapted to communicate the pressure to a component of the target device. Communicating the pressure to the target device can rupture of shift the component of the target device to modify the operation of the target device.

An example of a target device is a device configured to prevent the flow of fluid in a first direction and allow the flow of fluid in a second direction, such as (but not limited to) an inflow control device. The actuation assembly can configure the inflow control device such that the inflow control device allows or prevents the flow of fluid in the either direction.

In some aspects, the actuation assembly can recognize the target device electronically. Recognizing the target device electronically can include identifying the target device via a radio-frequency identification ("RFID") system. An RFID system can include a wireless non-contact system that uses radio-frequency electromagnetic fields to transfer data from a tag attached to an object for the purposes of automatic identification and tracking. The actuation assembly can include an RFID scanning device. The target device can include an RFID tag used to identify the target device. The RFID scanning device can scan the RFID tag to identify the target device. In response to identifying the target device using the RFID tag, the actuation assembly can generate pressure to be communicated to a rupture disc of the target device, thereby rupturing the disc. In some aspects, rupturing the rupture disc of a target device can create a bypass flow path allowing the flow of fluid through the target device. In other aspects, rupturing the rupture disc of a target device can change the position of a closure mechanism, such as a piston, thereby restricting or preventing the flow of fluid through the target device.

These illustrative examples are given to introduce the reader to the general subject matter discussed here and are not intended to limit the scope of the disclosed concepts. The following sections describe various additional aspects and examples with reference to the drawings in which like numerals indicate like elements, and directional descriptions are used to describe the illustrative aspects. The following sections use directional descriptions such as "above," "below," "upper," "lower," "upward," "downward," "left," "right," "uphole," "downhole," etc. in relation to the illustrative aspects as they are depicted in the figures, the upward direction being toward the top of the corresponding figure and the downward direction being toward the bottom of the corresponding figure, the uphole direction being toward the surface of the well and the downhole direction being toward the toe of the well. Like the illustrative aspects, the numerals and directional descriptions included in the following sections should not be used to limit the present invention.

FIG. 1 schematically depicts a well system 100 having target devices 114*a-c* and an actuation assembly 116. The well system 100 includes a bore that is a wellbore 102 extending through various earth strata. The wellbore 102 has a substantially vertical section 104 and a substantially horizontal section 106. The substantially vertical section 104 and the substantially horizontal section 106 may include a casing string 108 cemented at an upper portion of the substantially vertical section 104. The substantially horizontal section 106 extends through a hydrocarbon bearing subterranean formation 110.

A tubing string 112 extends from the surface within wellbore 102. The tubing string 112 can provide a conduit for formation fluids, such as production fluids produced from the subterranean formation 110, to travel from the substantially horizontal section 106 to the surface. Pressure from a bore in a subterranean formation can cause formation fluids, such as gas or petroleum, to flow to the surface.

Each of the target devices 114*a-c*, depicted as functional blocks in FIG. 1, is positioned in the tubing string 112 at a horizontal section 106. The target devices 114*a-c* can be coupled to the tubing string 112. The target devices 114*a-c* can be, for example, inflow control devices configured to regulate the flow rate from the subterranean formation 110.

Although FIG. 1 depicts the target devices 114*a-c* positioned in the substantially horizontal section 106, a target device can be located, additionally or alternatively, in the substantially vertical section 104. In some aspects, target devices can be disposed in simpler wellbores, such as wellbores having only a substantially vertical section. Although FIG. 1 depicts three target devices 114*a-c* positioned in the tubing string 112, any number of target devices can be used.

The actuation assembly 116, depicted as a functional block in FIG. 1, can be deployed in the tubing string 112. The actuation assembly 116 can recognize the target devices 114*a-c*. In some aspects, the actuation assembly 116 can electronically recognize the target devices 114*a-c*. For example, the actuation assembly 116 can recognize an RFID tag identifying each of the target devices 114*a-c*. In other aspects, the actuation assembly 116 can mechanically recognize the target devices 114*a-c*. For example, each of the target devices 114*a-c* can include a nipple profile specific to each target device.

In some aspects, the actuation assembly 116 can be powered by a local power source, such as a battery. The power source can provide sufficient power for the actuation assembly 116 to operate for a predetermined duration. The predetermined duration can be a duration greater than or equal to the duration of the movement of the actuation assembly 116 through tubing string 112. The power source may provide enough power for the actuation assembly 116 to operate as the actuation assembly 116 moves from the surface of the wellbore to the toe of the well system 100. The actuation assembly 116 can move to a collection point at the toe of the well system 100 or at some other location in the tubing string 112. The collection point can be, for example, a trash collection area having sufficient space that multiple actuation assemblies can be collected. In other aspects, the actuation assembly 116 can be coupled to a power source at the surface of the wellbore via, for example, an electrical cable.

The actuation assembly 116 can configure the target devices 114*a-c*. Configuring the target devices 114*a-c* can include opening or closing a valve, rupturing a disc, etc. For example, the target devices 114*a-c* can include inflow control devices positioned at different locations along the tubing string 112. Inflow control devices can modify the pressure of fluid flowing from a first section of the tubing string 112 to another section of the tubing string 112, thereby causing the fluid to flow through the tubing string 112 at a controlled rate.

Figure 2:
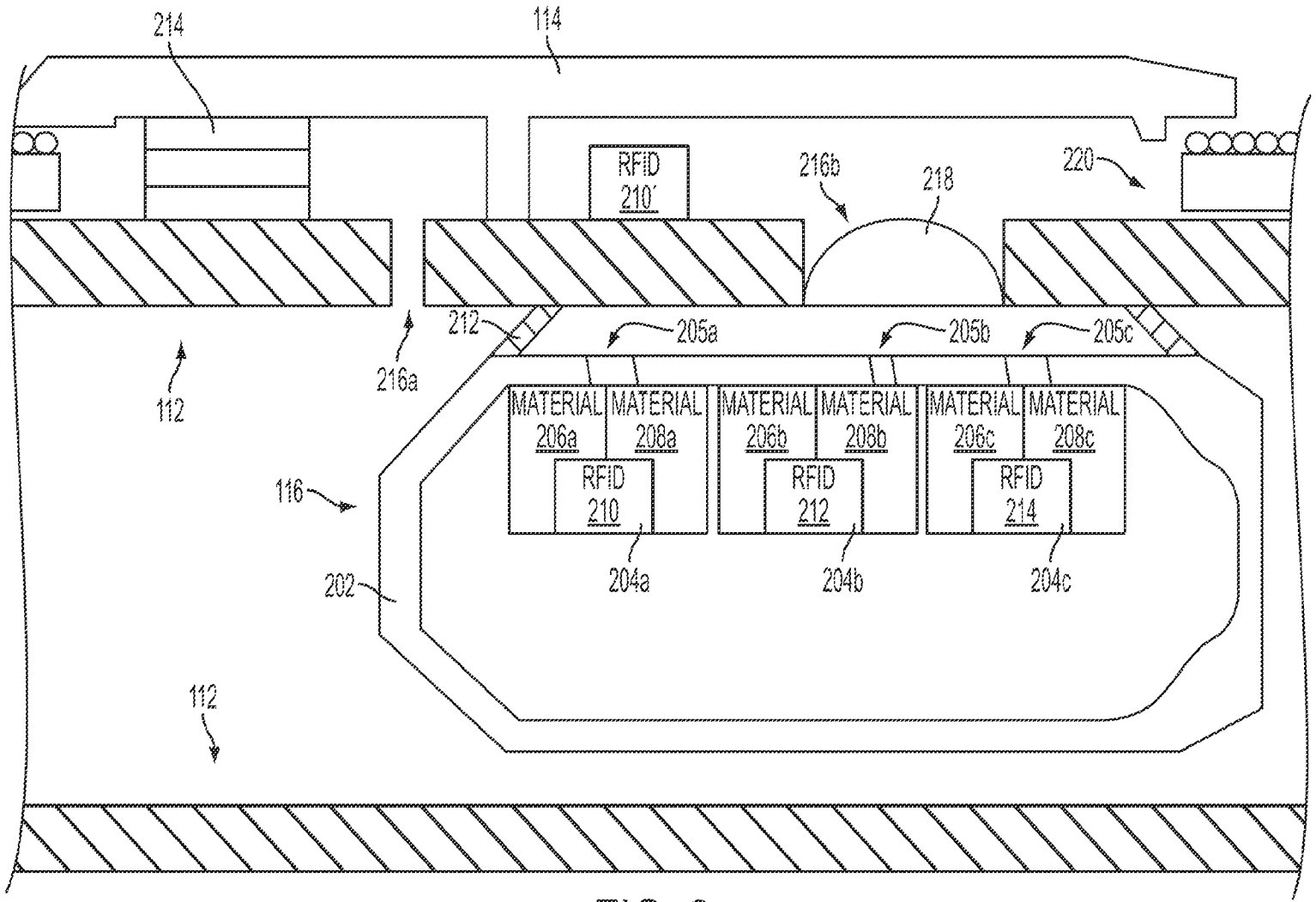
FIG. 2 is a cross-sectional view of an actuation assembly configured to bypass an inflow control device according to one aspect of the present invention.

FIG. 2 is a cross-sectional view of an actuation assembly 116 configured to bypass a target device 114 that is an inflow control device. The inflow control device may be bypassed to reduce the restriction of fluid flow through the tubing string 112. The actuation assembly 116 can be deployed into the tubing string to bypass inflow control devices having specific identifiers, such as RFID tags.

The actuation assembly 116 can be, for example, an RFID pod. The actuation assembly 116 can include a body 202, pressure-generating devices 204*a-c*, and a pressure containment mechanism 209. The pressure-generating device 204*a* can include an RFID scanning device 210 and materials 206*a*, 208*a*. The pressure-generating device 204*b* can include an RFID scanning device 212 and materials 206*b*, 208*b*. The pressure-generating device 204*c* can include an RFID device 214 and materials 206*c*, 208*c*.

The materials 206*a-c* and 208*a-c* can include chemicals adapted to react with one another. The reaction of the materials 206*a-c* with the materials 208*a-c* can generate pressure. Each of the ports 205*a-c* can be configured to communicate the pressure to the target device 114. The pressure communicated through the ports 205*a-c* can be contained by the pressure containment mechanism 209. The pressure containment mechanism 209 can be, for example, a flexible and rigid material adapted to create a seal. A non-limiting example of a pressure containment mechanism 209 is a rubber seal. Containing the pressure can cause the pressure to be communicated to a component of the target device 114, such as the rupture disc 218.

The target device 114 can include an inflow control device tube 214, an RFID tag 210', the rupture disc 218, and a bypass 220.

The target device 114 can restrict the flow of fluid using the inflow control device tube 214. A pressure differential of the inflow control device tub 214 can be used to regulate the flow rate of fluid flowing through the tubing string 112. Pressure differentials of inflow control devices can be obtained using different lengths and diameters for inflow control device tubes. Production fluid can flow through a flow path provided by the inflow control device tube 214 and the port 216*a*. The rupture disc 218 can prevent fluid from flowing through the bypass 220 and the port 216*b*.

The RFID scanning devices 210, 212, and 214 can be positioned in the body 202 such that the pressure-generating devices 204*a-c* are properly aligned with the target device 114 when the RFID tag 210' is scanned.

The RFID scanning device 210 can identify the target device 114 by scanning the RFID tag 210'. The pressure-generating device 204*a* can cause the materials 206*a*, 208*a* to contact one another in response to identifying the target device 114. In some aspects, the pressure-generating device 204*a* can cause the materials 206*a*, 208*a* to contact one another via a solenoid removing a barrier between the materials 206*a*, 208*a*. In other aspects, the pressure-generating device 204*a* can cause the materials 206*a*, 208*a* to contact one another by puncturing or melting a disc separating the materials 206*a*, 208*a*.

The materials 206*a*, 208*a* can react with one another. The reaction of the materials 206*a*, 206*b* can create pressure by, for example, causing gas to be released or expanded. The pressure containment mechanism 209 can contain the pressure. The reaction of the material 206*a*, 208*a* can be sufficiently rapid that the actuation assembly 116 can generate and communicate the pressure to the target device 114 without slowing or stopping. The reaction of the materials 206*a*, 208*a* can generate a pressure sufficient to rupture the rupture disc 218. The pressure containment mechanism 209 can communicate the pressure to the rupture disc 218, thereby rupturing the rupture disc. Rupturing the rupture disc 218 can allow fluid to flow through the bypass 220 and the port 216*b*, thereby bypassing the target device 114.

The pressure from the reaction of the materials 206*a*, 208*a* can be vented as the actuation assembly 116 moves through the tubing string 112. Changes in the shape of the inner diameter of the tubing string 112 can remove or break the seal formed by the pressure containment mechanism 209, thereby venting the pressure from the reaction of the materials 206*a*, 208*a*.

Figure 3:
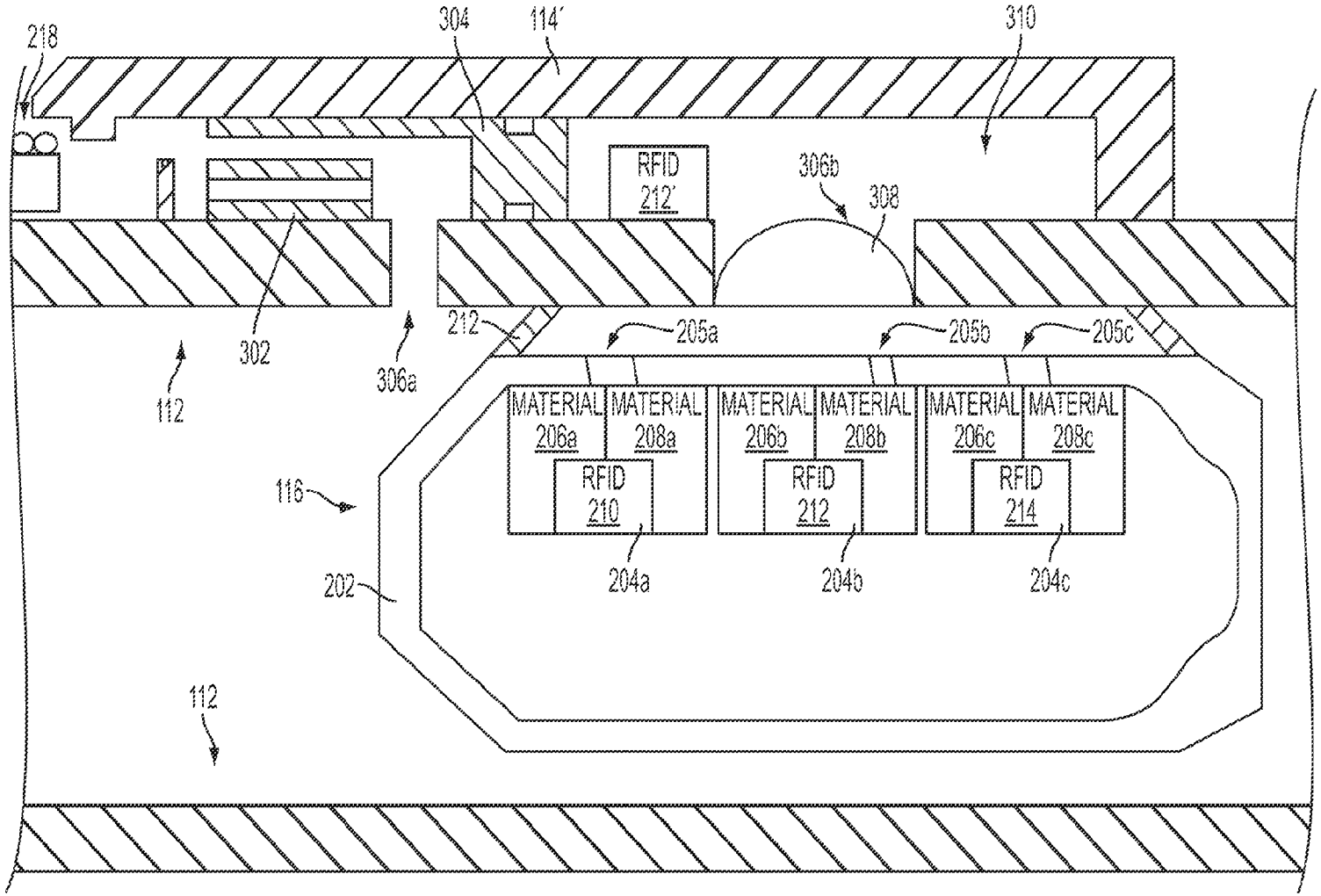
FIG. 3 is a cross-sectional view of an actuation assembly configured to close an inflow control device according to one aspect of the present invention.

The actuation assembly 116 can also configure a target device to restrict the flow of fluid through the tubing string 112. FIG. 3 is a cross-sectional view of an actuation assembly 116 configured to close a target device 114' that is an inflow control device.

The target device 114' can include an inflow control device tube 302 and a piston 304. Production fluid from the formation 110 can flow through a flow path provided by the inflow control device tube 302 and the port 306*a*. A chamber 310 of the target device 114' can be filled with an incompressible and inert fluid, such as (but not limited to) a hydraulic fluid or a silicon fluid. A rupture disc 308 can prevent the fluid from flowing out of the chamber 310 through the port 306*b*.

The target device 114' can be identified by an RFID tag 212'. The RFID scanning device 212 can be configured to recognize the RFID tag 212'. The pressure-generating device 204*b* can be configured to cause the materials 206*b*, 208*b* to contact one another in response to the RFID scanning device 212 recognizing the RFID tag 212'. Pressure can be generated by the materials 206*b*, 208*b* reacting with one another upon contacting one another.

The piston 304 of the target device 114' can be prevented from moving via a shear pin. The shear pin can be sheared by the amount of force generated from the reaction of the materials 206*b*, 208*b*. The pressure generated by the reaction of the materials 206*b*, 208*b* can rupture the rupture disc 306. The pressure can be communicated via the port 306*b* to the incompressible fluid in the chamber 310. The fluid can apply force to the piston 304 in response to the pressure being communicated to the fluid. The piston 304 can prevent the flow of fluid through the inflow control device 302 and the ports 306*a*.

In additional or alternative aspects, the pressure-generating devices 204*a-c* can generate pressure using a hydraulic mechanism. The hydraulic mechanism can include a reservoir with hydraulic fluid and a pump to generate pressure by communicating the hydraulic fluid to a target device 114.

The foregoing description of the aspects, including illustrated examples, of the invention has been presented only for the purpose of illustration and description and is not intended to be exhaustive or to limit the invention to the precise forms disclosed. Numerous modifications, adaptations, and uses thereof will be apparent to those skilled in the art without departing from the scope of this invention.

The invention claimed is:

1. An actuation assembly configured to be disposed in a wellbore through a fluid-producing formation, the actuation assembly comprising:

a body;

a potential force in the body;

a device in the body that is configured to cause the potential force to be released from the body in response to detecting a signal identifying a target device in the wellbore and external to the actuation assembly; and at least two chemicals in the body adapted to provide the potential force, wherein the device is configured to cause the potential force to be released by allowing the at least two chemicals to mix, and wherein the body is configured to communicate a pressure resulting from a reaction of the at least two chemicals in a direction away from the actuation assembly and toward the target device, wherein the body defines a port through which the pressure is communicated from the body to the target device external to the actuation assembly.

2. The actuation assembly of claim 1, wherein the device is configured to change a configuration of the target device by causing the potential force to be released.

3. The actuation assembly of claim 2, wherein the device is configured to change the configuration of the target device by causing the release of the potential force to rupture a rupture disc of the target device.

4. The actuation assembly of claim 1, wherein the device comprises a radio-frequency identification device configured to generate the signal by scanning a radio-frequency identification tag co-located with the target device, wherein the radio-frequency identification device is positioned with respect to the port such that the port is at least partially aligned with the target device when the radio-frequency identification tag is scanned by the radio-frequency identification device.

5. The actuation assembly of claim 1, further comprising a reservoir of fluid adapted to provide the potential force, wherein the device comprises a hydraulic mechanism, wherein the hydraulic mechanism is configured to cause the potential force to be released by communicating pressure generated from the fluid to a component of the target device.

6. A system configured to be disposed in a wellbore through a fluid-producing formation, the system comprising:

a target device; and an actuation assembly comprising:

a body;

a potential force in the body;

a device in the body that is configured to cause the potential force to be released from the body in response to identifying the target device, wherein the potential force is configured to change a configuration of the target device and the target device is external to the actuation assembly, and at least two chemicals in the body adapted to provide the potential force, wherein the device is configured to cause the potential force to be released by allowing the at least two chemicals to mix and to output a pressure from a reaction of the at least two chemicals, wherein the pressure is outputted in a direction away from the actuation assembly and toward the target device, wherein the device is configured to change the configuration of the target device by communicating pressure generated from the release of the potential force to a rupture disc of the target device.

7. The system of claim 6, wherein the device is configured to identify the target device by detecting a signal from the target device at a particular location.

8. The system of claim 6, wherein the target device comprises an inflow control device.

9. The system of claim 8, wherein the device is further configured to change the configuration of the inflow control device by communicating the pressure to a piston of the inflow control device.

10. The system of claim 8, wherein the rupture disc is configured to prevent fluid from flowing through a port bypassing the inflow control device.

11. The system of claim 6, wherein the device comprises a radio-frequency identification device configured to generate the signal by scanning a radio-frequency identification tag co-located with the target device.

12. The system of claim 6, further comprising a reservoir of fluid adapted to provide the potential force, wherein the device comprises a hydraulic mechanism, wherein the hydraulic mechanism is configured to cause the potential force to be released by communicating pressure generated from the fluid to a component of the target device.

13. An actuation assembly configured to be disposed in a wellbore through a fluid-producing formation, the actuation assembly comprising:

a body;

a potential force in the body;

a radio-frequency identification device configured to identify a target device external to the actuation assembly by scanning a radio-frequency identification tag co-located with the target device;

a device in the body that is configured to cause the potential force to be released from the body in response to identifying the target device; and at least two chemicals in the body adapted to provide the potential force, wherein the device is configured to cause the potential force to be released by allowing the at least two chemicals to mix and output a pressure from a reaction of the at least two chemicals, wherein the pressure is outputted in a direction away from the actuation assembly and toward the target device, wherein the device is configured to change the configuration of the target device by communicating the pressure to a rupture disc of the target device.

14. The actuation assembly of claim 13, wherein the target device comprises an inflow control device.

15. The actuation assembly of claim 13, further comprising a reservoir of fluid adapted to provide the potential force, wherein the device comprises a hydraulic mechanism, wherein the hydraulic mechanism is configured to cause the potential force to be released by communicating pressure generated from the fluid to a component of the target device.

* * * * *